United States Patent [19]

Suzuki

[11] 4,292,941

[45] Oct. 6, 1981

[54] ELECTRONIC IGNITION CONTROL SYSTEMS

[75] Inventor: Seigo Suzuki, Yokohama, Japan

[73] Assignee: Tokyo Shibaura Electric Co., Ltd., Japan

[21] Appl. No.: 176,292

[22] Filed: Aug. 8, 1980

Related U.S. Application Data

[63] Continuation of Ser. No. 876,176, Feb. 8, 1978, abandoned.

[30] Foreign Application Priority Data

Feb. 8, 1977 [JP] Japan ..... 52-12833

[51] Int. Cl.[3] ..... F02P 5/04

[52] U.S. Cl. ..... 123/416; 123/414; 123/417; 123/418

[58] Field of Search ..... 123/414, 416, 417, 418

[56] References Cited

U.S. PATENT DOCUMENTS

| | | | |
|---|---|---|---|
| 3,816,717 | 6/1974 | Yoshida et al. | 123/416 |
| 3,903,857 | 9/1975 | Hönig et al. | 123/416 |
| 3,904,856 | 9/1975 | Monpetit | 123/416 |
| 3,908,616 | 9/1975 | Sasayama | 123/416 |
| 3,923,022 | 12/1975 | Scholl | 123/416 |
| 3,927,648 | 12/1975 | Kawai et al. | 123/416 |
| 3,941,103 | 3/1976 | Hartig | 123/416 |
| 3,942,491 | 3/1976 | Seite et al. | 123/416 |
| 3,957,023 | 5/1976 | Peterson | 123/416 |
| 3,982,512 | 9/1976 | Garcea et al. | 123/416 |
| 3,996,911 | 12/1976 | Canup | 123/416 |
| 3,998,193 | 12/1976 | Ives et al. | 123/416 |
| 4,018,197 | 4/1977 | Salway | 123/416 |
| 4,019,484 | 4/1977 | Mori | 123/416 |
| 4,036,190 | 7/1977 | Bigliani et al. | 123/416 |
| 4,106,461 | 8/1978 | Giannini | 123/416 |
| 4,116,169 | 9/1978 | Krupp et al. | 123/416 |
| 4,119,069 | 10/1978 | Perrin | 123/416 |
| 4,127,091 | 11/1978 | Leichle | 123/416 |
| 4,131,097 | 12/1978 | Sawada et al. | 123/416 |

FOREIGN PATENT DOCUMENTS

| | | | |
|---|---|---|---|
| 2504843 | 8/1976 | Fed. Rep. of Germany | 123/416 |

*Primary Examiner*—Charles J. Myhre
*Assistant Examiner*—R. A. Nelli
*Attorney, Agent, or Firm*—Finnegan, Henderson, Farabow, Garrett & Dunner

[57] ABSTRACT

There are provided a counter, a memory device which stores a combustion delay information, that is an information regarding the time delay between ignition initiation and combustion, and a processor. In response to a clock pulse the counter measures the interval between adjacent combustion initiation points and produces a count information corresponding to the combustion interval. The combustion delay information is read out of the memory device by the count information. The processor produces an ignition time information in response to the count information and the combustion delay information. The ignition time information contains an information corresponding to the difference between the combustion initiation points and the combustion delay time, and is used to generate a succeeding ignition initiation time.

5 Claims, 4 Drawing Figures

ELECTRONIC IGNITION CONTROL SYSTEMS

This application is a continuation of U.S. application Ser. No. 876,176, filed Feb. 8, 1978, now abandoned.

This invention relates to an electronic ignition control system.

Recently, regulations regarding exhaust gas of motor cars became strict and for the purpose of satisfying such strict regulations, an electronic ignition control system has been developed according to which the ignition time is controlled by an electronic device. According to the ignition control system the advance spark angle (ACA) is expressed by a function of the number of revolutions (RPM) of the engine, and the ignition time is determined by such function for controlling the ignition of the engine. More particularly, the number of revolutions $\alpha$ of the crankshaft of the engine is detected by a suitable method and the ACA, that is $\beta$, is determined according to the following equation by utilizing a function $F(\alpha)$ of the number of revolutions: $\alpha$ $$\beta = F(\alpha) \tag{1}$$

The function $F(\alpha)$ has a tendency to increase straightly until the maximum output of the internal combustion engine is reached so that in a specific range of the speed, $\beta$ is expressed by a primary function as shown by equation (2):

$$\beta = K\alpha + \gamma \tag{2}$$

The ignition time is determined by the angle $\beta$ obtained from equation (1) or (2). In this case, the ignition time T is calculated by substituting the value of $\beta$ in the following equation (3):

$$T = \frac{\beta}{\frac{360}{n}} \times \frac{1}{\frac{\alpha}{60}} \Delta T \tag{3}$$

where n represents the number of cylinders of the internal combustion engine and $\Delta T$ is a correction term. The ignition pulse is generated in accordance with the ignition time determined by equation (3).

As above described, in order to determine the ignition time, it is necessary to calculate equation (1) or (2) and equation (3) with an electronic computer. Even when a high speed LSI computer is used for this purpose, it takes a process time of from 50 to 100 microseconds for multiplication and division operations alone, so that a total of 200 to 500 microseconds is necessary for the entire calculation. In an engine rotating at a speed of 10,000 RPM and having 6 cylinders, $\beta = 1°$, so that the value of the ignition time T is about 100 microseconds. This means that the processing time is longer than the ignition timing interval. Under such circumstances, with an electronic device utilizing a software, it is difficult to control, with real time, the ignition for an angle of approximately $\pm 1°$.

With the prior art electronic ignition system described above, $\beta$ is determined for an engine speed substantially corresponding to the maximum output of the engine so that the ignition time differs substantially from the correct time at low speeds. Accordingly, it is difficult to provide correct ignition time for the entire range of the engine speed.

Accordingly, it is an object of this invention to provide an electronic ignition control system capable of precisely setting the ignition initiation time and improving the accuracy of ignition control.

According to this invention there is provided an electronic ignition system comprising means for measuring the revolution or time of one rotation of an internal combustion engine, memory means for storing data each representing a combustion delay time corresponding to one of a plurality of rotation ranges of said internal combustion engine, and means for generating a timing information signal corresponding to a succeeding ignition initiation time in accordance with the time measured by the measuring means and a combustion delay time represented by a corresponding one of the data read out from the memory means.

This invention can be more fully understood from the following detailed description when taken in conjunction with the accompanying drawings, in which.

Figure 1:
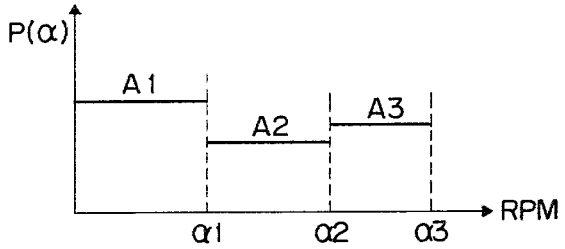
FIG. 1 is a graph showing the characteristics of the function term of the number of revolutions of an internal combustion engine.

In an internal combustion engine, the flame propagation delay time D, that is the time between the ignition initiation time and the time required by the flame generated by the spark to be propagated throughout the cylinder, is expressed by the following equation:

$$D = P(\alpha) + Q \tag{4}$$

where $P(\alpha)$ is a function of the number of revolutions of the engine and generally shown by a simple step shaped function as shown in FIG. 1. More particularly, $$P = A_1 \text{ in a range of } 0 \leqq \alpha < \alpha_1$$

$$P = A_2 \text{ in a range of } \alpha_1 \leqq \alpha < \alpha_2$$

$$P = A_2 \text{ in a range of } \alpha_2 \leqq \alpha \leqq \alpha_3 \tag{5}$$

As shown in FIG. 1, function $P(\alpha)$ is constant in each range.

In equation (4), Q represents a correction term regarding other variables such as the negative suction pressure, the degree of throttle valve opening, atmospheric pressure, ambient temperature, etc., and is independent of the number of revolutions $\alpha$. For this reason, the value of Q can be considered constant in a specific range of operation of the internal combustion engine. For example, in a range of $0 \leqq \alpha < \alpha_1$:

$$D = A_1 + Q \tag{6}$$

Figure 2:
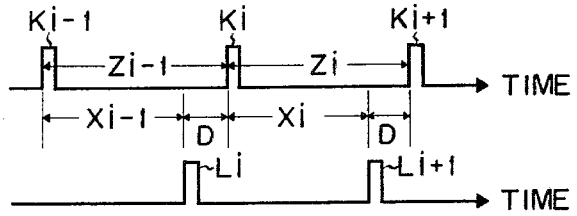
FIG. 2 is a time chart showing the combustion initiation period and the ignition period.

In the time chart shown in FIG. 2, $K_i$ represents an adequate ignition point (combustion initiating point) whereas $L_i$ represents the actual ignition pulse generating point. D represents the aforementioned flame propagation delay time which is determined by equation (4) or (5). The information regarding the combustion initiation points $K_{i-1}$, $K_i$ and $K_{i+1}$ may be used pulse signals generated at each operating period of the internal combustion engine, for example, pulse signals generated in proportion to the rotation of the engine by utilizing a photoelectric converting element. As can be noted from FIG. 2, the ignition pulse generating point $L_i$ for the combustion initiating point $K_i$ corresponds to a point later than time $K_{i-1}$ by an interval $X_{i-1}$. The interval between $K_{i+1}$ and $K_i$ can be measured by a counter when information regarding $K_i$ and $K_{i+1}$ are available. Thus, it is possible to determine $X_i$ from $(Z_i-D)$. However, at time $L_{i+1}$, $Z_i$ is not yet measured. However, if we assume that $Z_{i-1}$ is equal to $Z_i$ we can determine $X_i$ according to the following equation:

$$X_i=Z_{i-1}-D \tag{7}$$

From equations (4) and (7):

$$X_i=Z_i-\{P(\alpha)+Q\}=Z_i-Q-P(\alpha)$$

Hence, from equation (6)

$$X_i=Z_{i-1}-A_1-Q \tag{8}$$

Since $A_1$ and Q are constant in a certain range of speed, it is possible to simply determine interval $X_i$ by mere addition and subtraction of constants.

While in the foregoing description it was assumed that $Z_i=Z_{i-1}$, the error of this interval is only about 1/n rotation (where n represents the number of cylinders) so that such error is negligible. Actually, the time delay required to calculate the interval $X_i$ corresponds to the response time of the electronic ignition control system. The time required to determine the interval $Z_{i-1}$ and then to determine $X_i$ is about 10 to 50 μs. This means that the response of the electronic ignition control system is extremely fast and that the ignition timing can be obtained at an extremely high accuracy.

Figure 3:
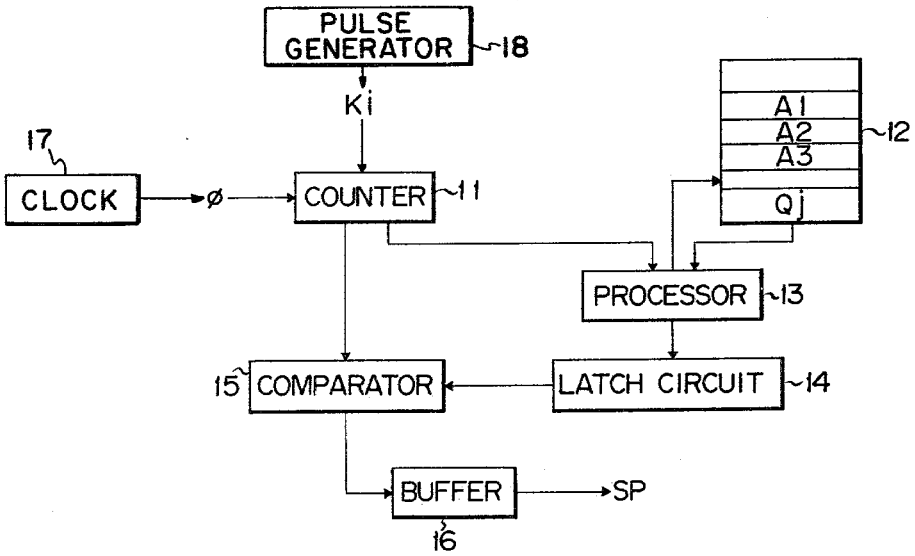
FIG. 3 is a block diagram of one embodiment of the electronic ignition system according to this invention.

FIG. 3 shows a block diagram of an electronic ignition control system which generates an ignition pulse according to the method described above in which, in response to a clock pulse $\phi_1$ from clock 18 counter 11 counts the periods of timing pulses $K_{i-1}$, $K_i$ and $K_{i+1}$ which are sequentially generated by a pulse generator 18, for example, a photoelectric converting element each time the crankshaft of the engine rotates a predetermined angle. The period of the clock pulse $\phi$ is from 10 to 50 μs. In a memory device 12 is stored information corresponding to the constants necessary to operate equation (8) and this memory device comprises a semi-fixed memory device, i.e., programmable read only memory or a fixed memory device, for example, a read only memory device. In response to a count information of the counter 11, a processor 13 reads out a constant information corresponding to the count information from the memory device 12 and operates equation (8) based on the constant information and the count information. The processor 13 may be comprised of a calculator or an adder, for example, 8 or 12 bit parallel adder. A latch circuit 14 is provided for temporarily storing the result of operation of equation (8) performed by processor 13. A comparator 15 is provided to compare the interval $X_i$ which has been determined by the preceding interval $Z_{i-1}$ according to equation (8) and stored in the latch circuit 13 with the content of counter 11 counting the clock pulses supplied thereto for measuring the pulse interval $Z_i$ between pulses $K_i$ and $K_{i+1}$. When the count values of the counter coincide with the value $X_i$, the comparator 15 produces a coincidence pulse which is applied to a buffer circuit 16 which produces an output signal SP that determines the ignition initiation time.

Figure 4:
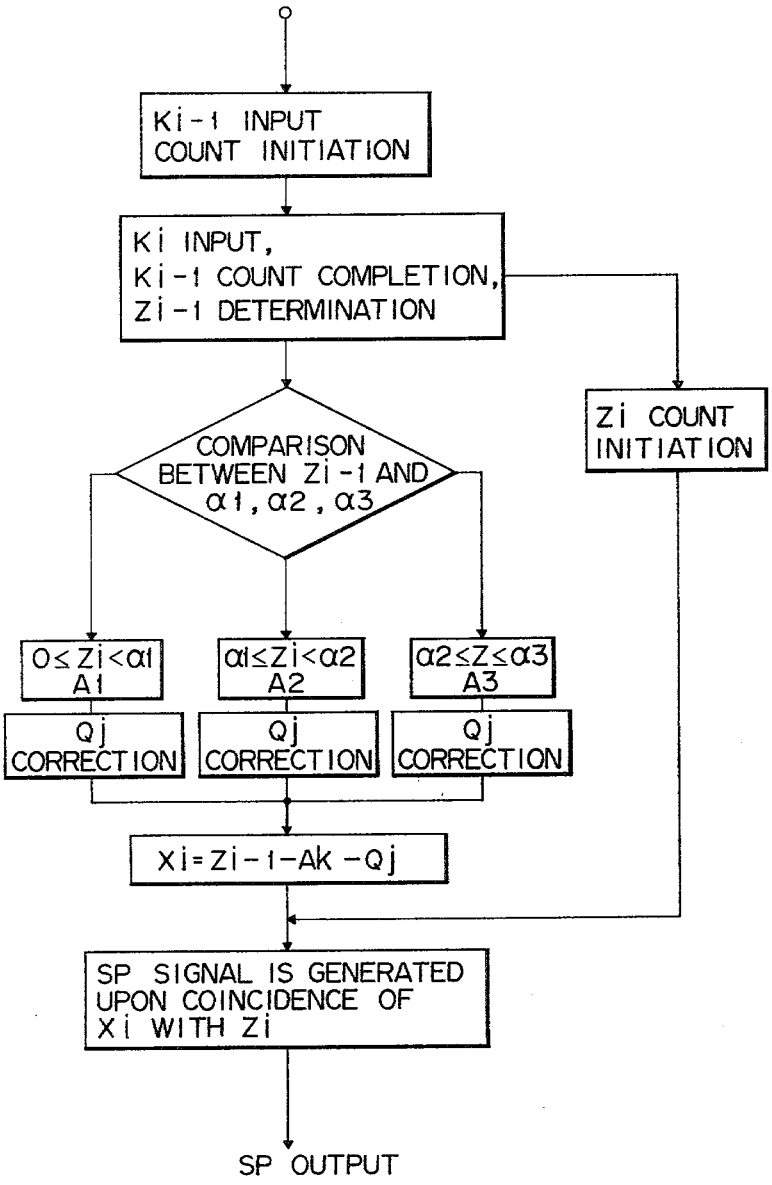
FIG. 4 is a flow chart useful to explain the operation of the electronic ignition system shown in FIG. 3.

The operation of the circuit shown in FIG. 13 will now be described with reference to the flow chart shown in FIG. 4. When supplied with a timing pulse $K_{i-1}$, the counter 11 begins to count the clock pulse $\phi$ and transmits to the processor 13 information of its content obtained between pulses $K_{i-1}$ and $K_i$, that is information corresponding to the pulse interval $Z_{i-1}$. Then the counter continues to count the pulse interval between pulses $K_i$ and $K_{i+1}$. The information regarding the interval $Z_{i-1}$ and sent to the processor 13 is compared with the number of revolutions of the engine, that is $\alpha_1$, $\alpha_2$ and $\alpha_3$. When $0<Z_{i-1}<\alpha_1$, constant $A_1$ is read out from the memory device, whereas when $0<Z_{i-1}<\alpha_2$ and $\alpha_2\leqq Z_{i-1}\leqq\alpha_2$, constants $A_2$ and $A_3$ are respectively read out from the memory device 12. In addition, a correction term data Q independent of the number of revolutions is read out in accordance with the information of $Z_{i-1}$. When this information is read out, the processor 13 operates an equation $X_i=Z_{i-1}-A_k-Q$ in accordance with this information (when k=1, 2 or 3). The $X_i$ information thus obtained is stored in the latch circuit 14.

The content of the counter starting from pulse $K_i$ is compared with the $X_i$ information in the latch circuit 14 by comparator 15, and when a coincidence is obtained, the comparator 15 produces an output pulse. As above described, this output pulse is applied to the ignition system through the buffer circuit 16 to act as an ignition initiation time signal. The operation described above is repeated in each revolution or reciprocation of the internal combustion engine.

As above described according to this invention a pulse signal is generated at each revolution or reciprocation of an internal combustion engine and the ignition period is calculated in accordance with the pulse signal. In accordance with the result of calculation, a corresponding combustion delay information is selected from a plurality of preset combustion delay constants and the selected combustion delay constants are added to or subtracted from the counted information for calculating the ignition initiation time of the succeeding cycle which is used to supply an ignition signal to an ignition plug. The combustion delay information contains an information in which constants regarding the number of revolutions and the correction term are expressed in terms of time or similar units and is contained in the memory device. The information regarding the constants and the correction term is read out continuously or discontinuously by the information regarding the period of rotation. By this method, the ignition initiation time is obtained efficiently and at high accuracies thus providing extremely accurate ignition times for all speeds of the engine.

What is claimed is:

1. An electronic ignition control system for an internal combustion engine comprising:

timing pulse means for generating a plurality of timing pulse signals the interval between successive ones of said pulse signals corresponding to each of successive rotations of said engine;

clock means for generating a plurality of clock pulses proportional to actual time;

counting means connected to said timing pulse means and said clock means for measuring the number of said clock pulses between successive ones of said timing pulse signals, said number representing the actual speed of rotation of said engine for the preceding revolution thereof, said counting means including means for storing said measured number;

a read-only memory containing a plurality of constants corresponding to the differences between the time a spark is generated in a cylinder of said engine and the time at which the flame generated by that spark has been propagated throughout the cylinder, each of said constants being correlated with a predetermined range in the speed of rotation of said engine;

calculating means for reading out one of said constants from said memory corresponding to the measured number stored in said counting means at a given time, and calculating from said measured number and said correlated constant, a value representing the time at which the next succeeding spark should be generated in a cylinder of said engine;

latch means connected to said calculating means for temporarily storing said value;

comparator means connected to said latch means and said counting means for comparing the number of said clock pulses occurring since the last of said timing pulse signals with the value in said latch means, and for producing a coincidence pulse when the number of clock pulses and the value coincide; and buffer means connected to said comparator means and responsive to receipt of said coincidence pulse for generating an output signal to create a spark in a cylinder of said engine.

2. The electronic ignition control system according to claim 1 wherein said calculating means comprises and 8 bit parallel adder.

3. The electronic ignition control system according to claim 1 wherein said clock pulses supplied to said counting means have a pulse interval of from 10 to 50 μs.

4. The electronic ignition control system according to claim 1 wherein said read-only memory is programmable.

5. The electronic ignition control system according to claim 1 wherein said calculating means comprises a 12 bit parallel adder.

* * * * *